US010126028B2

(12) United States Patent
Miyoshi et al.

(10) Patent No.: US 10,126,028 B2
(45) Date of Patent: Nov. 13, 2018

(54) TURBO CHILLER

(71) Applicant: MITSUBISHI HEAVY INDUSTRIES THERMAL SYSTEMS, LTD., Tokyo (JP)

(72) Inventors: Naoya Miyoshi, Tokyo (JP); Kenji Ueda, Tokyo (JP); Yasushi Hasegawa, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 88 days.

(21) Appl. No.: 15/505,380

(22) PCT Filed: Aug. 20, 2015

(86) PCT No.: PCT/JP2015/073445
§ 371 (c)(1),
(2) Date: Feb. 21, 2017

(87) PCT Pub. No.: WO2016/039114
PCT Pub. Date: Mar. 17, 2016

(65) Prior Publication Data

US 2018/0216857 A1 Aug. 2, 2018

(30) Foreign Application Priority Data

Sep. 8, 2014 (JP) ..... 2014-182091

(51) Int. Cl.
*F25B 39/04* (2006.01)
*F25B 1/10* (2006.01)
(Continued)

(52) U.S. Cl.
CPC ..... *F25B 39/04* (2013.01); *F25B 1/10* (2013.01); *F25B 9/002* (2013.01); *F25B 39/028* (2013.01);
(Continued)

(58) Field of Classification Search
CPC F25B 9/002; F25B 39/028; F25B 2341/0662; F25B 2339/047;
(Continued)

(56) References Cited

U.S. PATENT DOCUMENTS 4,558,885 A 12/1985 Asberg
4,573,526 A 3/1986 Jung
(Continued)

FOREIGN PATENT DOCUMENTS

CN 1979072 A 6/2007
CN 102410773 A 4/2012
(Continued)

OTHER PUBLICATIONS

Chinese Office Action and Search Report, dated Jun. 1, 2018 for Chinese Application No. 201580043965.1, with an English translation of the Chinese Office Action.
(Continued)

*Primary Examiner* — Emmanuel Duke
(74) *Attorney, Agent, or Firm* — Birch, Stewart, Kolasch & Birch, LLP

(57) ABSTRACT

This turbo chiller includes a shell-and-tube condenser; a header along a length direction of a shell is installed on a refrigerant inlet of the condenser, and openings are formed at least on both end portions of the header in the length direction, which allows high-temperature and high-pressure refrigerant gas from a compressor to be smoothly and evenly distributed to both length-direction end areas in the shell of the condenser through the header.

5 Claims, 5 Drawing Sheets

(51) Int. Cl.

| | |
|---|---|
| ***F28F 9/02*** | (2006.01) |
| ***F25B 39/02*** | (2006.01) |
| ***F25B 9/00*** | (2006.01) |
| *F28D 21/00* | (2006.01) |

(52) U.S. Cl.
CPC ..... *F28F 9/0278* (2013.01); *F25B 2339/047* (2013.01); *F25B 2341/0662* (2013.01); *F25B 2400/13* (2013.01); *F28D 2021/0073* (2013.01)

(58) Field of Classification Search
CPC ..... F25B 2400/13; F25B 49/022; F25B 1/02; F25B 1/053; F28F 9/0278; F28D 2021/0073; F04D 27/0269
See application file for complete search history.

(56) References Cited

U.S. PATENT DOCUMENTS

| | | | |
|---|---|---|---|
| 2004/0159121 | A1 | 8/2004 | Horiuchi et al. |
| 2006/0162918 | A1 | 7/2006 | Horiuchi et al. |

FOREIGN PATENT DOCUMENTS

| | | | |
|---|---|---|---|
| CN | 102967170 | A | 3/2013 |
| EP | 1397623 | B1 | 1/2009 |
| GB | 1413473 | A | 11/1975 |
| JP | 53-149957 | U | 11/1978 |
| JP | 54-19359 | U | 2/1979 |
| JP | 55-3238 | A | 1/1980 |
| JP | 59-12205 | A | 1/1984 |
| JP | 60-103277 | A | 6/1985 |
| JP | 2-154995 | A | 6/1990 |
| JP | 11-351786 | A | 12/1999 |
| JP | 2003-65695 | A | 3/2003 |
| JP | 2003-75024 | A | 3/2003 |
| JP | 2004-286246 | A | 10/2004 |
| JP | 2008-224213 | A | 9/2008 |
| JP | 2011-27296 | A | 9/2008 |
| WO | WO 02/103263 | A1 | 12/2002 |

OTHER PUBLICATIONS

Japanese Office Action, dated Apr. 17, 2018, for Japanese Application No. 2014-182091, with an English machine translation.

TURBO CHILLER

TECHNICAL FIELD

The present invention relates to a turbo chiller equipped with a shell-and-tube condenser.

BACKGROUND ART

In turbo chillers, conventionally, a water-cooled condenser is often used. In many cases, a shell-and-tube heat exchanger is used as the condenser; the shell-and-tube heat exchanger has a large number of heat transfer tubes installed in a shell, and heat-exchanges high-temperature and high-pressure refrigerant gas introduced into the shell with cooling water circulating through the heat transfer tubes, thereby condensing the refrigerant gas into liquid.

In such a condenser, high-temperature and high-pressure refrigerant gas discharged from a turbocompressor is introduced into a shell; this refrigerant gas is superheated gas with a high flow rate. Therefore, to prevent the refrigerant gas from directly impinging on heat transfer tubes in the condenser, or to prevent drift of the refrigerant gas in the shell, as shown in Patent Literature 1, a baffle plate is installed to be opposed to a refrigerant inlet to cause the refrigerant gas flow to impinge on the baffle plate. This prevents resonance, which is caused by the refrigerant gas flow impinging directly on the heat transfer tubes, and drift of the refrigerant gas flow.

CITATION LIST

Patent Literature

{PTL 1}
Japanese Unexamined Patent Application, Publication No. Sho60-103277

SUMMARY OF INVENTION

Technical Problem

However, as described above, in a condenser that distributes refrigerant gas in a shell by causing the refrigerant gas flow with a high flow rate to impinge on a baffle plate, when the refrigerant flow direction is changed by the baffle plate, the magnitude of a velocity vector in a longitudinal direction of the shell is not sufficiently great with respect to a velocity vector in a refrigerant entering direction, and the refrigerant is not be able to be sufficiently distributed to both longitudinal-direction end areas in the shell. Because of this, stagnation of the refrigerant flow occurs in the both end areas, which causes degradation of the condenser performance and the like. Furthermore, the pressure loss due to the impingement is high, and the increase in pressure loss of the refrigerant in the condenser causes the performance degradation, etc.

Particularly, in turbo chillers, in order to reduce the environmental load, adoption of an R1233zd(E) refrigerant or the like, which is one of hydrochlorofluoroolefin (HCFO) refrigerants that are low in both global warming potential (GWP) and ozone depletion potential (ODP), has been considered recently. As compared with currently-used high-pressure refrigerants such as R134a, this R1233zd(E) refrigerant is low-pressure and also low-density. Therefore, the volume flow rate of refrigerant gas flowing into a condenser is high, and an increase in the flow velocity is also predicted.

Consequently, if the condenser is a type that distributes a refrigerant by causing the refrigerant to impinge on a baffle plate, the pressure loss increases, and its low refrigerant distributing function increases the loss on the refrigeration cycle.

The present invention has been made in view of these circumstances, and an object of the present invention is to provide a high-performance turbo chiller with a condenser of which performance is improved by the enhancement of a refrigerant distributing function of distributing a refrigerant to both longitudinal-direction end areas in a shell and the reduction of the refrigerant pressure loss.

Solution to Problem

To solve the above-described problem, the turbo chiller according to the present invention adopts the following means.

That is, a turbo chiller according to a first aspect of the present invention is a turbo chiller equipped with a shell-and-tube condenser; a header along a length direction of a shell is installed on a refrigerant inlet of the condenser, and openings are formed at least on both end portions of the header in the length direction, which allows high-temperature and high-pressure refrigerant gas from a compressor to be smoothly and evenly distributed to both length-direction end areas in the shell of the condenser through the header.

According to the first aspect of the present invention, the header along the length direction of the shell is installed on the refrigerant inlet of the shell-and-tube condenser, and the openings are formed at least on both end portions of the header in the length direction, which allows high-temperature and high-pressure refrigerant gas from the compressor to be smoothly and evenly distributed to the both length-direction end areas in the shell of the condenser through the header. Accordingly, the high-temperature and high-pressure refrigerant gas introduced from the compressor into the condenser can be evenly distributed to the both length-direction end areas in the shell through the header installed on the refrigerant inlet from the openings formed on the both length-direction end portions smoothly. Therefore, as compared with a type of condenser that distributes a refrigerant by causing the refrigerant to impinge on a baffle plate, the pressure loss can be reduced, and the condenser performance can be improved. Furthermore, a refrigerant is sufficiently supplied to the both end areas in the shell, and the refrigerant is evenly distributed over the entire area in the shell with no flow stagnant areas, thereby the entire heat-transfer surface can be effectively utilized. Moreover, by the even distribution of the refrigerant, the refrigerant flow to a group of heat transfer tubes is averaged, and the flow resistance is reduced, thereby the pressure loss in the condenser can be further reduced, and the condenser performance can be improved, which can further enhance the performance of the turbo chiller.

Furthermore, a turbo chiller according to a second aspect of the present invention is that in the above-described turbo chiller, a guide vane for guiding the high-temperature and high-pressure refrigerant gas flowing from the refrigerant inlet smoothly to the both length-direction end areas is installed in the header.

According to the second aspect of the present invention, the guide vane for guiding the high-temperature and high-pressure refrigerant gas flowing from the refrigerant inlet smoothly to the both length-direction end areas is installed in the header. Accordingly, the high-temperature and high-pressure refrigerant gas flowing from the refrigerant inlet into the header can be smoothly guided to the both length-direction end areas of the header along the guide vane, and can be distributed in the shell from the openings formed on the both end portions of the header. Therefore, the high-temperature and high-pressure refrigerant gas introduced into the condenser can be smoothly distributed in the right and left directions by the header at the inlet, and the pressure loss is reduced, and the distributivity of the refrigerant is improved, which can improve and the condenser performance.

Moreover, a turbo chiller according to a third aspect of the present invention is that in the above-described turbo chiller, the openings are formed to gradually increase their opening area from a center part to each end part.

According to the third aspect of the present invention, the openings are formed to gradually increase their opening area from a center part to each end part. Accordingly, the high-temperature and high-pressure refrigerant gas introduced into the header can be distributed more to the both length-direction end areas in the shell by the openings formed to gradually increase their opening area from the center part to each end part. Therefore, the distribution of the refrigerant over the entire area in the shell can be further uniformized, and the entire heat-transfer surface can be effectively utilized. Furthermore, the further improvement of the condenser performance can be achieved by further reducing the flow resistance of the refrigerant in the shell and reducing the pressure loss.

Furthermore, a turbo chiller according to a fourth aspect of the present invention is that in the above-described turbo chiller, the header is configured to branch to the right and left into duct-like parts extending toward the both length-direction ends of the shell, and the openings are formed on distal-end-side portions of the duct-like parts, respectively.

According to the fourth aspect of the present invention, the header is configured to branch to the right and left into duct-like parts extending toward the both length-direction ends of the shell, and the openings are formed on distal-end-side portions of the duct-like parts, respectively. Accordingly, the high-temperature and high-pressure refrigerant gas introduced into the header can be distributed in the right and left directions through the branch duct-like parts extending toward the both length-direction ends of the shell, and the refrigerant gas can be evenly distributed to the both end areas in the shell through the openings formed on the distal-end-side portions of the duct-like parts, respectively. Therefore, the high-temperature and high-pressure refrigerant gas introduced into the condenser is smoothly distributed by the header at the inlet, and the pressure loss is reduced, and the distributivity of the refrigerant is improved, which can improve the condenser performance.

Advantageous Effects of Invention

According to the present invention, high-temperature and high-pressure refrigerant gas introduced from the compressor into the condenser can be evenly distributed to the both length-direction end areas in the shell through the header installed on the refrigerant inlet from the openings formed on the both length-direction end portions smoothly. Therefore, as compared with a type of condenser that distributes a refrigerant by causing the refrigerant to impinge on a baffle plate, the pressure loss can be reduced, and the condenser performance can be improved. Furthermore, a refrigerant is sufficiently supplied to the both end areas in the shell, and the refrigerant is evenly distributed over the entire area in the shell with no flow stagnant areas, thereby the entire heat-transfer surface can be effectively utilized. Moreover, by the even distribution of the refrigerant, the refrigerant flow to a group of heat transfer tubes is averaged, and the flow resistance is reduced, thereby the pressure loss in the condenser can be further reduced, and the condenser performance can be improved, which can further enhance the performance of the turbo chiller.

DESCRIPTION OF EMBODIMENTS

Embodiments according to the present invention are explained below with reference to drawings.

First Embodiment

A first embodiment of the present invention is explained below with FIGS. 1 and 2.

Figure 1:
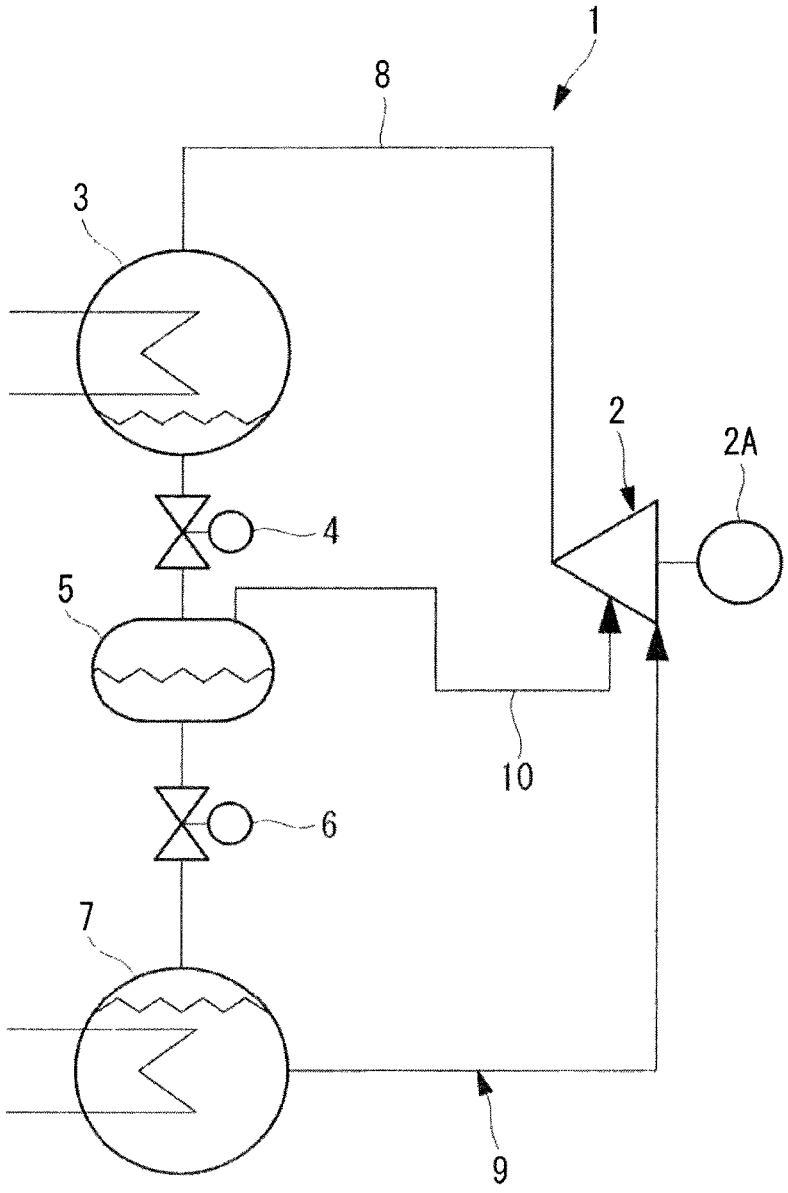
FIG. 1 is a refrigeration cycle diagram of a turbo chiller according to a first embodiment of the present invention.
Figure 2A:
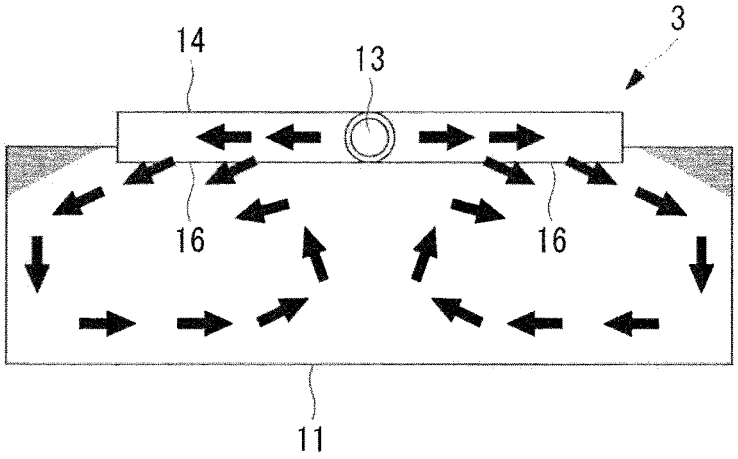
FIG. 2(A) is a front view of a condenser composing the turbo chiller.
Figure 2B:
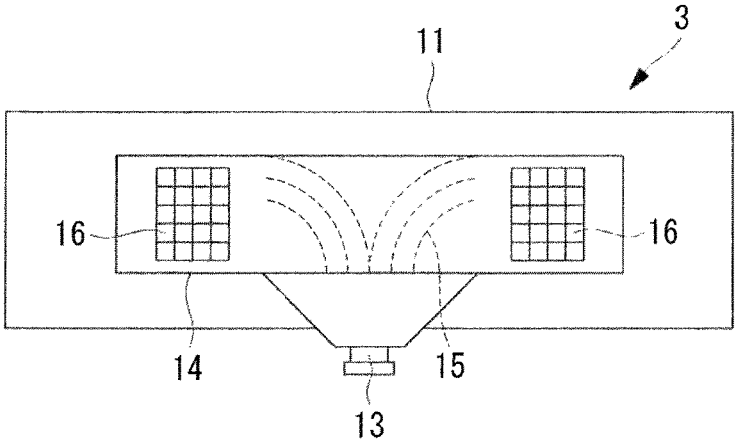
FIG. 2(B) is a plan view of the condenser.
Figure 2C:
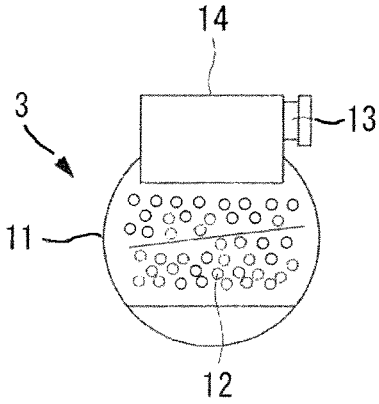
FIG. 2(C) is a left side view of the condenser.

FIG. 1 shows a refrigeration cycle diagram of a turbo chiller according to the first embodiment of the present invention; FIG. 2(A) shows a front view of a condenser composing the turbo chiller, FIG. 2(B) shows a plan view of the condenser, and FIG. 2(C) shows a left side view of the condenser.

A turbo chiller 1 includes a multistage turbocompressor (also referred to simply as a compressor) 2 that is driven by a motor 2A and compresses a refrigerant, a shell-and-tube condenser 3 that condenses the high-temperature and high-pressure refrigerant gas compressed by the compressor 2 into liquid, a first expansion valve 4 as a first pressure-reducing means that reduces the pressure of the condensed liquid refrigerant to intermediate pressure, an intercooler (a gas-liquid separator) 5 that serves as an economizer, a second expansion valve 6 as a second pressure-reducing means that reduces the pressure of the liquid refrigerant to low pressure, and a shell-and-tube evaporator 7 that evaporates the refrigerant passing through the second expansion valve 6; these are sequentially connected by a refrigerant pipe 8, thereby composing a refrigeration cycle 9 that is a closed cycle.

The refrigeration cycle 9 in the present embodiment includes a publicly-known economizer circuit 10 that injects a gas refrigerant separated and evaporated by the intercooler 5 into intermediate-pressure refrigerant gas compressed in the low-stage side of the multistage turbocompressor 2 through an intermediate port. The economizer circuit 10 here is the gas-liquid separation type of economizer circuit 10 where the intercooler 5 is composed of a gas-liquid separator. Alternatively, the economizer circuit 10 can be an intercooler type of economizer circuit that diverts a part of the refrigerant condensed by the condenser 3, and reduces the pressure of this refrigerant and heat-exchanges the refrigerant with liquid refrigerant. Incidentally, the economizer circuit 10 is not essential in the present invention.

Furthermore, here, to reduce the environmental load, the refrigeration cycle 9 shall be filled with a required amount of R1233zd(E) refrigerant or the like, which is one of hydrochlorofluoroolefin (HCFO) refrigerants that are low in both global warming potential (GWP) and ozone depletion potential (ODP). This R1233zd(E) refrigerant is a low-pressure refrigerant and is low in density, and is known to have about one fifth of the density of a high-pressure refrigerant such as an R134a refrigerant which is one of HFC refrigerants used in existing turbo chillers.

Moreover, FIGS. 2(A) to 2(C) show a schematic configuration diagram of the shell-and-tube condenser 3 incorporated in the refrigeration cycle 9.

This condenser 3 includes a drum-shaped shell 11, where a water chamber is formed by installing tube plates on the sides of both length-direction ends of the shell 11, respectively, and a large number of heat transfer tubes 12 are installed between the two tube plates; the condenser 3 circulates cooling water cooled by a cooling tower or the like in the large number of heat transfer tubes 12 through a water pipe and a pump, and at the same time, the condenser 3 introduces high-temperature and high-pressure refrigerant gas compressed by the compressor 2 into the shell 11 through a refrigerant pipe and a refrigerant inlet 13 to condense the refrigerant into liquid by heat-exchanging the refrigerant gas with the cooling water. The condenser 3 itself is a publicly-known one.

The condenser 3 in the present embodiment is provided with a header 14 for introducing high-temperature and high-pressure refrigerant gas supplied from the compressor 2 smoothly into the shell 11 through the refrigerant inlet 13 and evenly distributing the refrigerant gas over the entire area in the shell 11. This header 14 is placed on top of the shell 11 in which a group of the heat transfer tubes 12 is installed along the length direction of the shell 11, and is a cuboid header with the refrigerant inlet 13 formed horizontally in the length-direction center thereof.

Furthermore, in the header 14, a plurality of guide vanes 15 for smoothly changing the direction of the refrigerant gas flow introduced from the refrigerant inlet 13 toward the sides of both longitudinal-direction ends of the header 14 are installed in a continuous manner on an inside portion corresponding to the refrigerant inlet 13, and openings 16 allowing refrigerant gas flow to be evenly distributed over the entire area in the shell 11 are formed on both longitudinal-direction end portions of the header 14 so as to prevent the occurrence of stagnation of the refrigerant gas flow of which the direction has been changed in the shell 11, especially in both end parts of the shell 11. Incidentally, to let the refrigerant gas flow in every direction in the shell 11 in a distributed manner, it is preferable that the openings 16 are provided with, for example, a grid-like guide member or the like.

By the above-described configuration, the present embodiment achieves the following effects.

In the above-described turbo chiller 1, when the compressor 2 has been driven by the motor 2A, a low-pressure gas refrigerant is sucked from the evaporator 7, and is compressed in multiple stages into high-temperature and high-pressure refrigerant gas. The high-temperature and high-pressure refrigerant gas discharged from the compressor 2 is transferred to the condenser 3, and is condensed into liquid by heat exchange with cooling water in the condenser 3. This liquid refrigerant is supercooled through the first expansion valve 4, the intercooler 5 serving as an economizer, and the second expansion valve 6, and the pressure of the refrigerant is reduced to low pressure, and then the refrigerant is introduced into the evaporator 7. The refrigerant introduced into the evaporator 7 is heat-exchanged with a cooled medium, and cools the cooled medium, and the refrigerant itself evaporates, and then again is sucked into the compressor 2 and repeats the action of being compressed.

Furthermore, the intermediate-pressure refrigerant that the liquid refrigerant has been separated and evaporated by the intercooler (the gas-liquid separator) 5 and has been supercooled is injected into the intermediate-pressure refrigerant gas that has passed through the economizer circuit 10 and compressed by a low-stage-side compression unit through the intermediate port of the multistage turbocompressor 2. This fulfills a function as an economizer that improves the refrigeration capacity.

On the other hand, the refrigeration cycle 9 of this turbo chiller 1 is filled with an R1233zd(E) refrigerant which is low in both global warming potential (GWP) and ozone depletion potential (ODP). This refrigerant is a low-pressure refrigerant and is low in density (about one fifth of the density of an R134a refrigerant), and therefore is regarded to be difficult to secure the ability. However, in general, a turbocompressor is regarded to be suitable for compression of a high-flow refrigerant, and its weakness can be covered by high rotation, thereby increasing the refrigerant circulation volume.

At this time, the volume flow rate of the high-temperature and high-pressure refrigerant gas flowing from the turbocompressor 2 into the condenser 3 is higher than that of a refrigeration cycle using a high-pressure refrigerant, the flow velocity also increases further. Therefore, in a conventional type of condenser that distributes refrigerant gas in the shell 11 by causing the refrigerant gas to impinge on the baffle plate installed to be opposed to the refrigerant inlet 13, the pressure loss in the condenser 3 increases, and also it is difficult to evenly distribute a refrigerant over the entire area in the shell 11; therefore, impairment of the ability of the chiller is predicted.

However, in the present embodiment, the shell-and-tube condenser 3 is provided with the header 14 installed on the refrigerant inlet 13 along the length direction of the shell 11, and the openings 16 are formed at least on both length-direction end portions of the header 14, and the condenser 3 is configured to be able to smoothly and evenly distribute high-temperature and high-pressure refrigerant gas from the compressor 2 to both length-direction end areas in the shell 11 of the condenser 3 through the header 14. Accordingly, through the header 14 installed on the refrigerant inlet 13, the high-temperature and high-pressure refrigerant gas introduced from the compressor 2 into the condenser 3 can be evenly distributed to the both length-direction end areas in the shell 11 from the openings 16 formed on both length-direction end portions of the header 14 smoothly.

Therefore, as compared with the conventional type that distributes a refrigerant by causing the refrigerant to impinge on a baffle plate, the pressure loss in the condenser 3 can be reduced, and the condenser performance can be improved. Furthermore, a refrigerant can be sufficiently supplied to the both end areas in the shell 11, and the refrigerant can be evenly distributed over the entire area in the shell 11 with no flow stagnant areas; therefore, the entire heat-transfer surface can be effectively utilized. Moreover, by the even distribution of the refrigerant, the refrigerant flow to the group of the heat transfer tubes 12 can be averaged, and the flow resistance can be reduced, thereby the pressure loss in the condenser 3 can be further reduced, and the condenser performance can be improved, which can further enhance the performance of the turbo chiller 1.

Furthermore, in the present embodiment, the plurality of guide vanes 15 for guiding high-temperature and high-pressure refrigerant gas flowing from the refrigerant inlet 13 into the header 14 smoothly to the both length-direction end areas are installed. Accordingly, the high-temperature and high-pressure refrigerant gas flowing from the refrigerant inlet 13 into the header 14 can be smoothly guided to the both length-direction end areas of the header 14 along the guide vanes 15, and can be distributed in the shell 11 from the openings 16 formed on both end portions of the header 14. Therefore, the high-temperature and high-pressure refrigerant gas introduced into the condenser 3 can be smoothly distributed in the right and left directions by the header 14 at the refrigerant inlet 13, and the pressure loss is reduced, and the distributivity of the refrigerant is improved, which can improve the condenser performance.

Second Embodiment

Figure 3A:
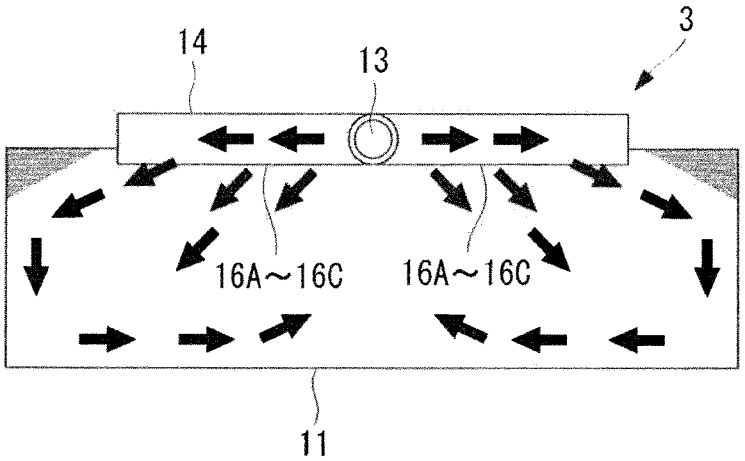
FIG. 3(A) is a front view of a condenser according to a second embodiment of the present invention.

Subsequently, a second embodiment of the present invention is explained with FIGS. 3 and 4.

The present embodiment differs from the above-described first embodiment in a configuration of openings 16A to 16C or 16D formed on the header 14. The rest are the same as in the first embodiment, so description is omitted.

In the present embodiment, the openings 16A to 16C or 16D for distributing refrigerant gas flowing from the header 14 into the shell 11 over the entire area in the shell 11 are formed to gradually increase their opening area from the center part to both end parts of the header 14.

Figure 3B:
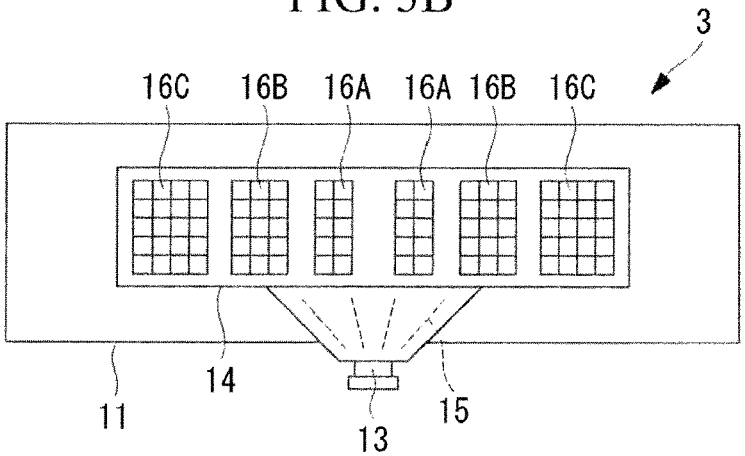
FIG. 3(B) is a plan view of the condenser.
Figure 3C:
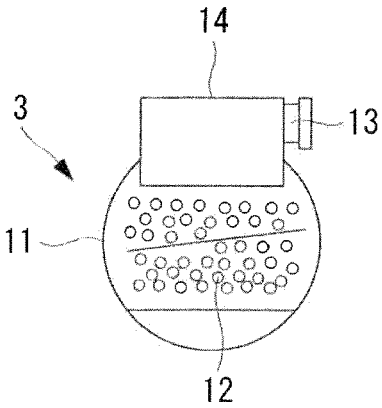
FIG. 3(C) is a left side view of the condenser.
Figure 4A:
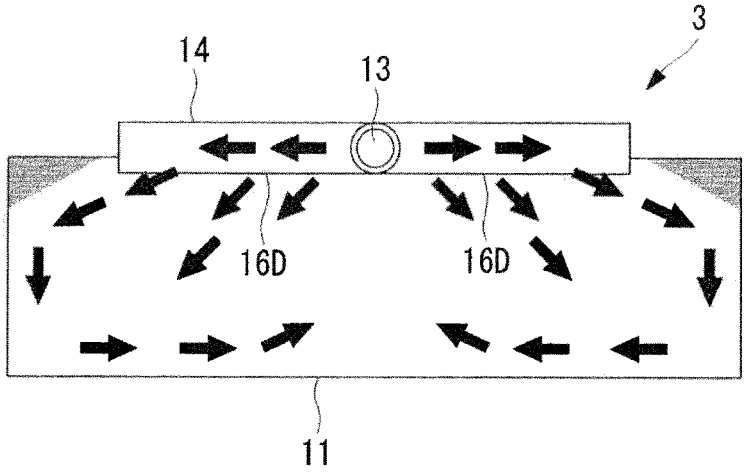
FIG. 4(A) is a front view showing a modification of the condenser.
Figure 4B:
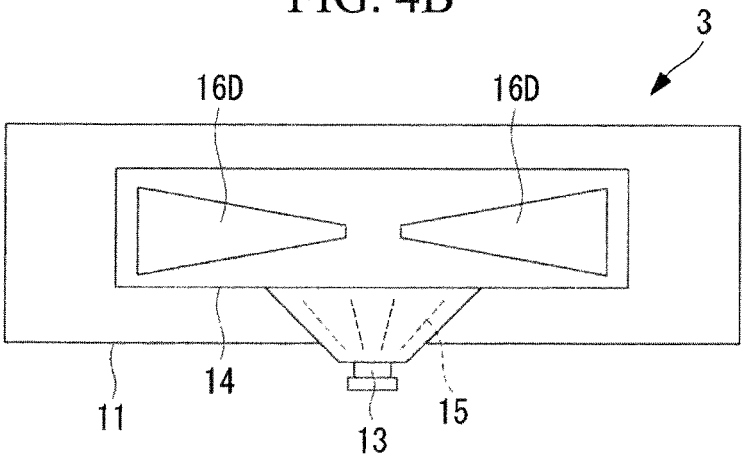
FIG. 4(B) is a plan view showing the modification of the condenser.
Figure 4C:
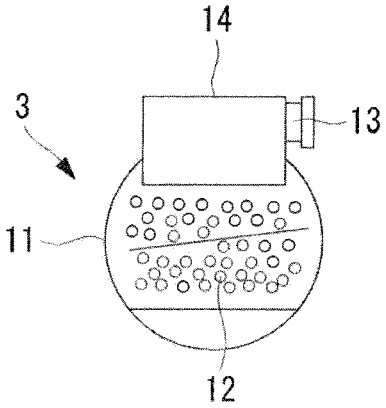
FIG. 4(C) is a left side view showing the modification of the condenser.

That is, a first form is, as shown in FIG. 3(B), that two sets of three openings 16A to 16C are formed from the center part to both end parts of the header 14, respectively, and respective opening areas of the three openings 16A to 16C in each set are set to gradually increase step by step toward the side of each end part. Furthermore, a second form that is a modification of the first form is, as shown in FIG. 4(B), the opening area of a pair of openings 16D continuously formed from the center part to both end parts of the header 14, respectively, is set to gradually increase continuously toward the side of each end part.

In this way, the openings 16A to 16C or 16D formed on the header 14 are configured to set to gradually increase their opening area from the center part to each end part, thereby high-temperature and high-pressure refrigerant gas introduced into the header 14 can be distributed more to both length-direction end areas in the shell 11. Accordingly, the distribution of the refrigerant over the entire area in the shell 11 can be further uniformized, and the entire heat-transfer surface can be effectively utilized. Furthermore, the further improvement of the condenser performance can be achieved by further reducing the flow resistance of the refrigerant in the shell 11 and reducing the pressure loss.

Incidentally, in the present embodiment, to let the refrigerant gas flow in every direction in the shell 11 in a distributed manner, it is preferable that each of the openings 16A to 16C or 16D is provided with, for example, a grid-like guide member or the like, just like the first embodiment.

Third Embodiment

Subsequently, a third embodiment of the present invention is explained with FIG. 5.

The present embodiment differs from the above-described first and second embodiments in that a header 14A of the condenser 3 has a branch duct structure. The rest are the same as in the first embodiment, so description is omitted.

Figure 5:
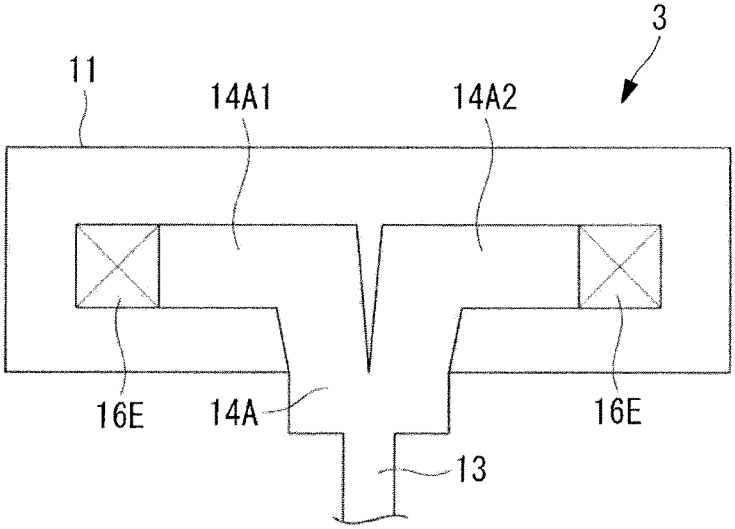
FIG. 5 is a plan view of a condenser according to a third embodiment of the present invention.

In the present embodiment, as shown in FIG. 5, the header 14A installed in the condenser 3 is configured to branch to the right and left into two parts 14A1 and 14A2 like ducts, and the duct-like parts 14A1 and 14A2 extend to the right and left along the length direction of the shell 11, respectively.

Then, the duct-like parts 14A1 and 14A2 are configured to have an opening 16E formed on respective distal-end-side portions thereof so that refrigerant gas can be evenly distributed to both length-direction end areas in the shell 11. Incidentally, this opening 16E is provided with a grid-like guide member or the like for letting the refrigerant gas flow in every direction in a distributed manner, just like the above-described embodiments.

In this way, the header 14A of the condenser 3 is configured to branch to the right and left into the two duct-like parts 14A1 and 14A2 extending toward the both length-direction ends of the shell 11, and the openings 16E are formed on the distal-end-side portions of the duct-like parts 14A1 and 14A2, respectively. Accordingly, high-temperature and high-pressure refrigerant gas introduced into the header 14A can be distributed in the right and left directions through the branch duct-like parts 14A1 and 14A2 extending toward the both length-direction ends of the shell 11, and the refrigerant gas can be evenly distributed to both end areas in the shell 11 through the openings 16E formed on the distal-end-side portions of the duct-like parts 14A1 and 14A2, respectively. Hereby, the high-temperature and high-pressure refrigerant gas introduced into the condenser 3 is smoothly distributed by the header 14A at the refrigerant inlet 13, and the pressure loss is reduced, and the distributivity of the refrigerant is improved, which can improve the condenser performance.

Incidentally, the present invention is not limited to the invention according to the above-described embodiments, and modification can be appropriately made without departing from the scope of the invention. For example, in the above embodiments, there is described an example using an HCFO refrigerant that is a low-pressure refrigerant and is low in both GWP and ODP in order to reduce the environmental load. However, the present invention is not limited to the type of refrigerant used, and, needless to say, can be applied to a turbo chiller using a high-pressure refrigerant.

Furthermore, according to the above embodiments, there is described an example in which the header 14 has a horizontally-long cuboid shape; however, the shape of the header 14 is not limited to this, and can be an elliptical shape or other shapes. Moreover, the shape of the guide vanes 15 is not particularly limited as long as the guide vanes 15 can smoothly change the direction of the high-temperature and high-pressure refrigerant gas flow flowing into the header 14 to the right and left directions so as not to cause the pressure loss.

Furthermore, in the above embodiments, there is described that it is preferable that the openings 16, 16A to 16E are provided with a grid-like guide member; however, this guide member is not limited to a grid-like guide member, and any guide member can be used as long as the guide member can let the refrigerant gas flow flowing out from the openings flow in every direction in a distributed manner.

REFERENCE SIGNS LIST

1 Turbo chiller
2 Multistage turbocompressor (Compressor)

3 Condenser
11 Shell
12 Heat transfer tube
13 Refrigerant inlet
14, 14A Header
14A1, 14A2 Duct-like part
15 Guide vane
16, 16A, 16B, 16C, 16D, 16E Opening

The invention claimed is:

1. A turbo chiller equipped with a shell-and-tube condenser, and a header placed on top of a shell and along a length direction of the shell is installed on a refrigerant inlet of the condenser, and openings communicated with an inside of the shell are formed at least on both end portions of the header in the length direction, which allows high-temperature and high-pressure refrigerant gas from a compressor to be smoothly and evenly distributed to both length-direction end areas in the shell of the condenser through the header.

2. The turbo chiller according to claim 1, wherein a guide vane for guiding the high-temperature and high-pressure refrigerant gas flowing from the refrigerant inlet smoothly to the both length-direction end areas is installed in the header.

3. The turbo chiller according to claim 2, wherein the openings are formed to gradually increase their opening area from a center part to each end part.

4. The turbo chiller according to claim 1, wherein the openings are formed to gradually increase their opening area from a center part to each end part.

5. The turbo chiller according to claim 1, wherein the header is configured to branch to the right and left into duct-like parts extending toward both length-direction ends of the shell, and the openings are formed on distal-end-side portions of the duct-like parts, respectively.

* * * * *